United States Patent [19]

Kogler et al.

[11] 4,070,063

[45] Jan. 24, 1978

[54] DIVIDING CUTTING MACHINE

[75] Inventors: Peter Kogler, Knittelfeld; Arnulf Kissich, Zeltweg, both of Austria

[73] Assignee: Vereinigte Osterreichische Eisen- und Stahlwerke - Alpine Montan Aktiengesellschaft, Vienna, Austria

[21] Appl. No.: 719,155

[22] Filed: Aug. 31, 1976

[30] Foreign Application Priority Data

Sept. 2, 1975 Austria ..... 6769/75

[51] Int. Cl.[2] ..... E21C 27/20; E21C 35/20

[52] U.S. Cl. ..... 299/64; 299/75

[58] Field of Search ..... 299/64, 71, 72, 75, 299/76

[56] References Cited

U.S. PATENT DOCUMENTS

| | | | |
|---|---|---|---|
| 1,332,662 | 3/1920 | Gross | 299/64 X |
| 2,595,398 | 5/1952 | Lewis | 299/64 X |
| 2,788,202 | 4/1957 | Barrett | 299/64 X |

*Primary Examiner*—Ernest R. Purser

*Attorney, Agent, or Firm*—Cushman, Darby & Cushman

[57] ABSTRACT

A dividing cutting machine includes a cutter boom pivotable about a horizontal axis, at least one cutter head disposed on the cutter boom, a loader deck hingedly connected to the frame of the dividing cutting machine pivotable about a horizontal axis and provided with movable gathering arms for continuously sweeping the mined material upwardly over the loader deck to conveying means. Stops mounted on the cutter boom and on the loader deck at locations spaced from their respective horizontal pivot axes have a height which precludes physical contact between the cutter boom and the gathering arms in each mutual pivotal position.

5 Claims, 4 Drawing Figures

DIVIDING CUTTING MACHINE

This invention relates to a dividing cutting machine comprising a cutter boom pivotable about a horizontal axis and about a vertical axis, at least one cutter head disposed on the cutter boom, a loader deck hingedly connected to the frame of the dividing cutting machine pivotable about a horizontal axis and provided with movable gathering arms for continuously sweeping the mined material upwardly over the loader deck to conveying means. In such dividing cutting machines having a cutter boom which is pivotable in all directions, and a loader deck which is pivotable upwardly, there is a danger of collision between the cutter boom and the loader deck if and when the latter is swung upwardly which sometimes becomes necessary where the mine floor is uneven, and if the cutter boom is in a downward position. The power-operated movable gathering arms are arranged on the upper surface of the loader deck, and in case of a collision of the cutter boom with the loader deck the gathering arms may collide with the cutter boom, too, so that there is a danger of damaging the gathering arms. To avoid such a danger of damaging, heretofore shear pins had been included in the power transmission system of the gathering arms so that in case of an overload the shear pins break whereby failure of the gathering arms or damage to the power transmission system shall be avoided. Broken shear pins have to be replaced which is a rather time - consuming work so that in case of rupture of the shear pins considerable downtime must be taken into account. With respect to the capacity of a dividing cutting machine and to the fact that replacement of components of the machine operating below ground is not easy, such a downtime is very costly.

It is the object of this invention to eliminate these drawbacks, and the invention is essentially characterized by cooperating stop means mounted on the cutter boom and on the loader deck in a diestance from their respective horizontal pivot axes and having a height which precludes a physical contact between the cutter boom and the gathering arms in each and every mutual pivotal position. Thereby any blocking of the gathering arms by the cutter boom is definitely avoided.

The gathering arms collect the mined material from both sides and move it to the middle of the loader deck and upwardly to conveying means formed by a belt conveyor or a chain conveyor. For keeping the conveying path unobstructed, the stop means on the loader deck preferably are formed by two bails mounted at both sides of the conveying means and extending sideways. In this embodiment the stop means on the cutter boom preferably is formed by a plate whose width is greater than the distance between said bails. Thereby it is ensured that the stop means can cooperate in all lateral angular pivotal positions if the cutter boom and the loader deck come closer to each other in a dangerous way. Lateral pivotal movement of the cutter boom takes place about a vertical swivel axis. For accomodating the stop means to this pivotal movement it is preferable to arrange the bails in such a way that they, seen in top plan view, lie approximately tangential to a circle whose center lies on the vertical swivel axis of the cutter boom.

According to a preferred embodiment of this invention in the lifting drive of the loader deck there is included a lifting force limiting means such as an overload valve communicating with the pressure chamber of a hydraulic lifting cylinder, for limiting the lifting force of the loader deck to a value which is less than the vertical pivoting force component of the cutter boom. The pivoting force of the cutter boom has to be very high so that the requirements of cutting work can be fulfilled. On the other hand, the lifting force of the loader deck only has to be sufficient for lifting the loader deck off the mine floor. By limiting said lifting force to a value sufficient for lifting the loader deck, by means of an overload valve, overloading in case of collision is being avoided.

These and other objects of the invention will be more completely disclosed and described in the following specification, the accompanying drawings and the appended claims.

Figure 1:
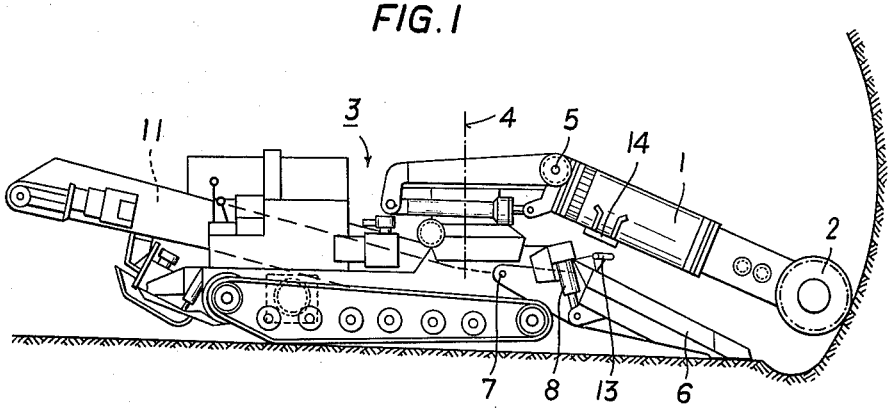
FIG. 1 is a side elevation of a dividing cutting machine in accordance with the invention.
Figure 2:
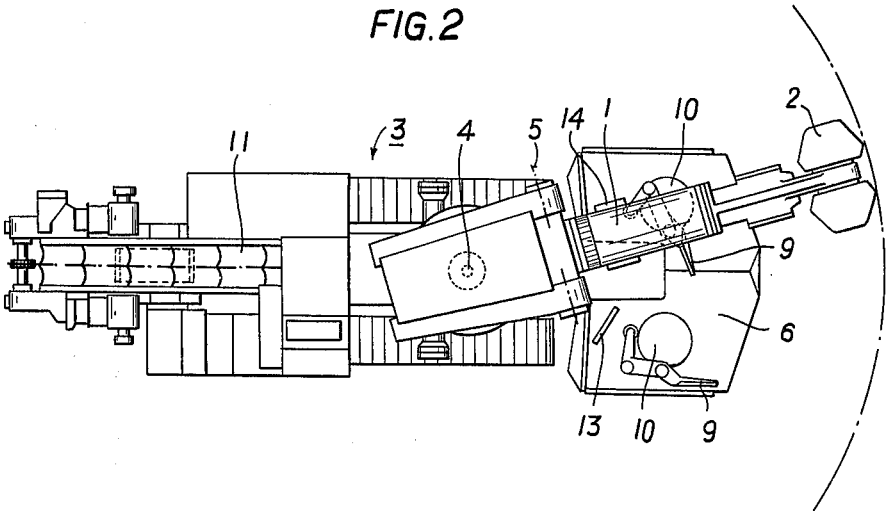
FIG. 2 is a plan view of the machine illustrated in FIG. 1.
Figure 4:
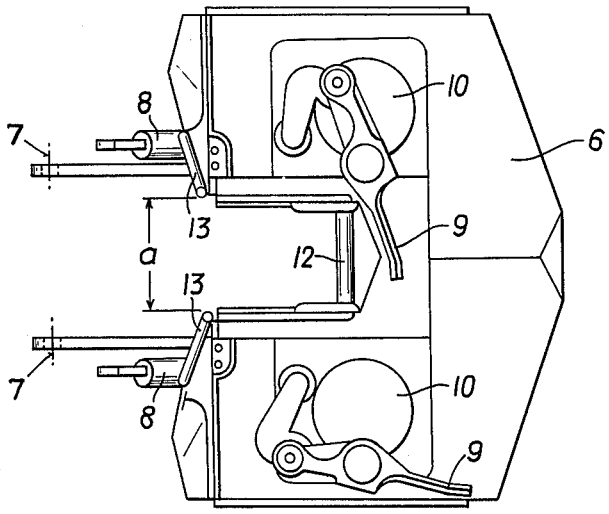
FIG. 4 is a plan view of the loader deck, also on an enlarged scale.

Referring to the drawings and particular FIGS. 1 and 2, a cutter boom 1 with rotary cutter heads 2 is mounted on frame 3 of a dividing cutting machine for pivotal movement in all directions. Pivotal movement in horizontal direction is carried out about a vertical axis 4, and pivotal movement in vertical direction is carried out about a horizontal axis 5. A loader deck 6 is hingedly connected to the frame 3 pivotable about a horizontal axis 7. A hydraulic cylinder 8 is provided as lifting drive means for the loader deck 6. On the upper surface of the loader deck 6 gathering arms 9 are arranged movably (see FIG. 4). The gathering arms 9 are driven by rotating discs 10. Because of their shape the gathering arms 9 are called "lobster's claws". A chain conveyor or belt conveyor 11 has a forward end 12 which reaches into a clearance of the loader deck 6. By the kind of movement of the gathering arms 9 the mined material is being swept to said forward end 12 of the conveyor 11.

Bails 13 are mounted on the loader deck 6. Said bails are arranged at both sides of the forward end or intake end 12 of the conveyor 11 so that they do not obstruct the feed of mined material to the conveyor. The bails 13 are arranged obliquely so that they lie approximately tangential to a circle having its center on the axis 4. As counterstop means for the bails 13 a plate 14 is mounted on the cutter boom 1. The width of said plate is greater than the distance *a* between the bails 13 (FIG. 4), so that the plate 14 is effective as stop means in all lateral angular pivotal positions of the cutter boom 1. The heights of the bails 13 and of the plate 14 is dimensioned to protect the cutter boom 1 and the gathering arms 9 against collision between each other in each and every mutual position.

The hydraulic lifing cylinders 8 are provided with an overload valve indicated by a circle 15 (FIG. 3) by the action of which in case of a collision the loader deck 6 may be forced downwardly by the cutter boom 1.

Figure 3:
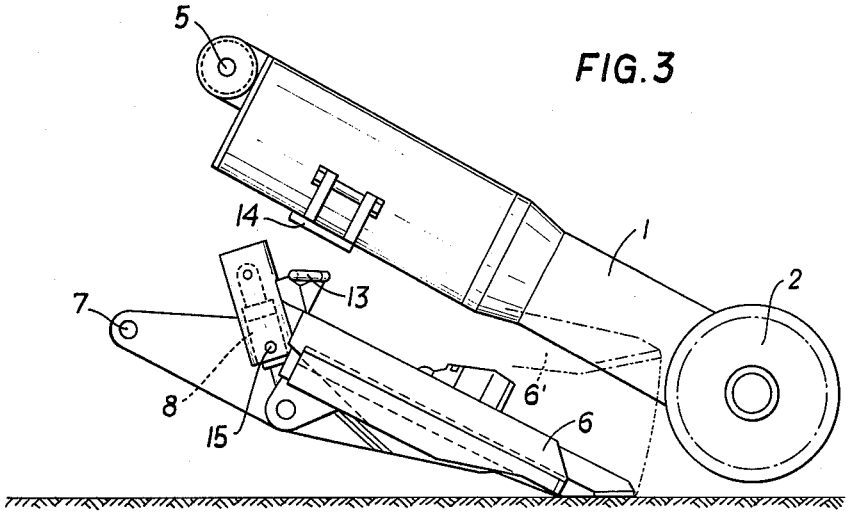
FIG. 3 is a side elevation of only the loader deck and the cutter boom on an enlarged scale.

FIG. 3 shows in dash-dot-lines the loader deck 6 in its elevated position 6'. Thereby it can be seen that in dependence of the height of the elevated position either the bails 13 engage the plate 14, or the forward end of the loader deck 6 engages the cutter boom 1. In both cases the gathering arms 9 are protected against collision with the cutter boom 1.

What we claim is:

1. A dividing cutting machine comprising a machine frame, a cutter boom pivotable relative to the frame about a horizontal axis and about a vertical axis, at least one cutter head disposed on the cutter boom, a loader deck below the boom hingedly connected to the frame of the dividing cutting machine for movement about only a horizontal axis relative to the frame, said deck being provided with conveying means and with movable gathering arms for continuously sweeping the mined material upwardly over the loader deck to the conveying means, separate independent stop means mounted on the cutter boom and on the loader deck at a distance from their respective horizontal pivot axes and having a height which by virtue of engagement of the stop means with each other precludes physical contact between the cutter boom and the gathering arms in each and every mutual pivotal position of the boom and deck.

2. A dividing cutting machine as in claim 1 wherein the conveyor means extends longitudinally of the machine and the stop means provided on the loader deck is formed by two bails mounted at both sides of the conveying means and extending sideways.

3. A dividing cutting machine as in claim 2 wherein the bails, seen in top plan view, lie approximately tangential to a circle whose center lies on the vertical swivel axis of the cutter boom.

4. A dividing cutting machine as in claim 2 wherein the stop means on the cutter boom is formed by a plate whose width is greater than the distance between the bails.

5. A dividing cutting machine as in claim 1 including a hydraulic lifting cylinder for the loader deck and an overload valve communicating with the pressure chamber of the hydraulic lifting cylinder for limiting the lifting force of the loader deck to a value which is less than the vertical pivoting force component of the cutter boom.

* * * * *